United States Patent [19]

Murphy et al.

[11] 3,933,252

[45] Jan. 20, 1976

[54] RAILROAD CAR UNCOUPLING LEVER WITH ANTIFRICTION SLIDEWAY ARRANGEMENT

[75] Inventors: Richard F. Murphy, Aurora; Osvaldo F. Chierici, Elmhurst, both of Ill.

[73] Assignee: Holland Company, Lombard, Ill.

[22] Filed: Nov. 11, 1974

[21] Appl. No.: 522,467

[52] U.S. Cl. ..... 213/166; 213/219

[51] Int. Cl.[2] ..... B61G 3/08

[58] Field of Search ..... 213/211, 166, 167, 168, 213/169, 170, 171, 219

[56] References Cited

UNITED STATES PATENTS

| | | | |
|---|---|---|---|
| 3,409,146 | 11/1968 | Taylor | 213/166 |
| 3,438,513 | 4/1969 | Miller et al. | 213/166 |
| 3,814,267 | 6/1974 | Chierici | 213/219 X |

*Primary Examiner*—M. Henson Wood, Jr,
*Assistant Examiner*—Michael Mar
*Attorney, Agent, or Firm*—Mann, Brown, McWilliams & Bradway

[57] ABSTRACT

An uncoupling lever assembly for railroad cars that includes an uncoupling lever with an improved slideway arrangement for accommodating extension and contraction of the lever assembly, which lever assembly comprises a handle section and a lock lifter section each including an elongate rectilinear bar. The handle section bar has an operating handle affixed to one end of same for pivotal connection to the car and the lock lifter section bar has a lock lifter rod member affixed to one end of same having a hook eye adapted for application to the coupler lock lifter. The lock lifter bar has secured to one side of same adjacent its other end a single elongate tubular member that defines a single slideway for the lever assembly having self-lubricating antifriction characteristics in which the handle section bar is slidably received. The lever assembly bars are in side by side relation, with the slideway forming tubular member being slidably mounted on the handle section bar, and the handle section bar projecting through the slideway and inboard of same when the coupler is in its neutral centered relation relative to the car.

16 Claims, 10 Drawing Figures

RAILROAD CAR UNCOUPLING LEVER WITH ANTIFRICTION SLIDEWAY ARRANGEMENT

This invention relates to an uncoupling lever assembly for railroad cars, and more particularly, to improvements in the uncoupling lever assembly shown in U.S. Pat. No. 3,834,554, granted Sept. 10, 1974, the entire disclosure of which is hereby incorporated herein by this reference.

Railroad car uncoupling levers that are arranged to be extensible and retractable in nature to accommodate coupler swing and buff and draft movement of the coupler have come into wide use. Such arrangements usually involve one or more points of take up and let out in the effective length of the uncoupling assembly, ordinarily in the form of a bar operating in or along a slideway, the arrangement being such that the bar and slideway are in cranking relation so that torque applied to the assembly by the operator is transmitted to the assembly hook eye for operating the lock lifter. The take up and let out components heretofore employed have been defined by elements formed from steel or the like to insure the necessary strength and rigidity required of such parts. The relatively movable parts involved typically involve a steel on steel sliding contact or engagement.

It is, of course, essential to continued effective operation of these devices that they should smoothly extend and contract in response to coupler movement relative to the car. However, the exposed mounting position of such devices subjects them to exposure to the elements as well as to foreign matter churned up as the train in which the car may be incorporated moves over the tracks.

It has resulted that much difficulty has been experienced with conventional uncoupling levers of the type indicated due to the tendency of the take up and let out components of same to fail to consistently have the freedom of relative movement needed to accommodate coupler movement when the car is in use, due to the tendency of the relatively movable parts involved to jam for one reason or another. Lubrication of the parts involved may provide temporary benefits, but can create safety hazards as the uncoupling lever assembly is sometimes used as a foothold by trainmen. Consequently, uncoupling lever assemblies providing for take up and let out have continued to experience an unsatisfactory amount of jamming with consequent failure as the parts involved bend and break when they are jammed to the point that they no longer accommodate the coupler movements that are involved.

In analyzing this problem, tests have shown that in uncoupling lever assemblies involving steel sliding on steel in the take up and let out components of same, only a few thousand take up and let out cycles can result in galling of the parts involved, which can be followed by loss of the necessary free sliding action due to binding of the parts involved and resultant failure, even in the absence of foreign matter accumulations.

A principal object of the invention is to provide a slideway arrangement for uncoupling lever assemblies of the type involving take up and let out in service, which slideway is of a self-lubricating long wearing nature and requires no application of lubricant for continued freedom of operation.

Another principal object of the invention is to provide a slideway arrangement connecting relatively movable torque transmitting parts of uncoupling lever assemblies that insures continued functioning of the free shifting action in such relatively movable parts to the extent that the frequently encountered jamming or freezing of such parts that results in premature disablement of the device is avoided.

Yet another principal object of the invention is to provide an uncoupling lever assembly slideway arrangement that is oriented to achieve longitudinal alignment of the relatively movable extension bars that may be involved, for efficient extension and contraction movement thereof, as well as torque transmittal action therethrough, when the uncoupling lever is fully extended.

Other objects of the invention are to provide a one piece slideway tube of self-lubricating long wearing characteristics, as well as a manner of securing same in place that involves minimum parts and ease of application, and to provide an uncoupling lever arrangement that is economical of manufacture, convenient to install and use, and long lived in operation.

In accordance with this invention, the slideway is in the form of a one piece tube formed from a high density type polymer having self-lubricating characteristics, and specifically an ultra high molecular weight polymer, such as polyethylene having a molecular weight of at least 2,000,000, which tube when incorporated in, for instance, the uncoupling lever assembly of the type shown in said patent, is secured in place on the lock lifter section bar thereof by a pair of mounting brackets disposed at either end of same, in which tube is received and held in desired position without being bonded either to the brackets or to the lock lifter section bar. The tube provides a slideway defining bore that receives the handle section bar in free sliding relation thereto, with the parts being proportioned so that some cocking of the tube relative to the handle section bar is accommodated, as may be occasioned by correct application of the assembly hook eye to the coupler lock lifter, with the result that binding of the hook eye with the lock lifter that sometimes occurs when the lock lifter is operated, due to minor misalignment problems, is avoided. The securement of the tube holding brackets is such that an angulation or canting of the slideway forming tube results, relative to the lock lifter section bar, which insures that the handle section and lock lifter section bars act in parallelism when the assembly is at or near its full extension. The result is that the lock lifter section tube operates on the handle section bar with minimum dynamic coefficient of friction characteristics and free shifting movement of these parts is assured even though the tube may be cocked somewhat out of alignment with the handle section bar.

Other objects, uses, and advantages will be obvious or become apparent from a consideration of the following detailed description and the application drawings in which like reference numerals indicate like parts throughout the several views.

In the drawings:

FIG. 1 is a fragmental plan view of one end of a railroad car (shown in the form of a flatcar) that is assumed to be equipped for standard draft gear cushioning, showing one embodiment of the present invention applied thereto, with the coupler shown in a largely diagrammatic manner, and with the full line showing of the uncoupling lever assembly having the normal riding position of same when the coupler is centered relative to the car;

Figure 2:
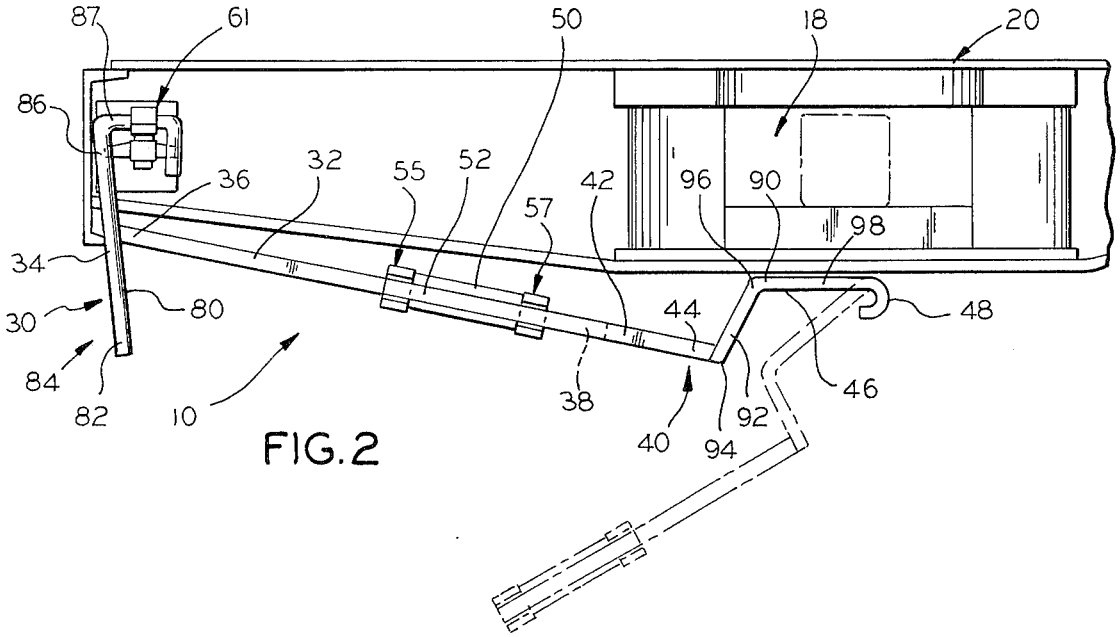
FIG. 2 is an end view of the structure shown in FIG. 1, on a somewhat enlarged scale, taken from the right hand side of FIG. 1, and also showing in phantom the lock lifter section of the uncoupling assemblies separated from the handle section of the assembly for application or removal with respect to the coupler.

However, it is to be distinctly understood that the specific drawing illustrations provided are supplied primarily to comply with the requirements of the Patent Laws, and that the invention is susceptible of modifications and variations that will be obvious to those skilled in the art, and which are intended to be covered by the appended claims.

GENERAL DESCRIPTION

Reference numeral 10 of the drawings generally indicates an uncoupler lever assembly in which a preferred embodiment of the invention is incorporated, assembly 10 being applied between the end 12 of a car body underframe 14 and coupler 16 that is suitably mounted on the car 15 of which the underframe 14 forms a part.

The underframe 14 is intended to represent a typical flatcar having the usual fixed center sill 18 equipped with the usual striker 20. Coupler 16 is mounted in the fixed sill in any conventional manner, and it is assumed that it is operatively connected to the center sill and/or the car body 14 through a conventional type of draft gear mechanism, an example of which is shown in U.S. Pat. No. 2,811,263, whereby the car 15 is equipped for standard draft gear cushioning of coupler impacts applied to the coupler 16 (standard draft gear travel being in the range of 2¾ inches for buff impacts and 1¼ inches for draft impacts).

As is well known in the art, the car body underframe 14 is supported on the railroad track by suitable trucks (not shown), and the shank 19 of the coupler is secured to the car for swinging movement to either side of the car longitudinal center line.

The uncoupling lever assembly 10 is basically that shown in said U.S. Pat. No. 3,834,554, but arranged in accordance with the present invention. Assembly 10 is applied between the car body bracket 22 that is suitably anchored to the car body end sill 24, and the usual lock lifter or uncoupling knuckle (not shown) of the coupler 16.

The lever assembly 10 generally comprises handle section 30 that includes an elongate rectilinear bar 32 of rectangular transverse cross-sectional configuration having handle portion 34 of same affixed, as by welding, to one end 36 of the bar 32. The bar 32 is free and unencumbered for the full length of same, between its outboard end 36, and its inboard end 38, for being freely received in the lock lifter section 40 of the assembly.

The lock lifter section 40 comprises elongate rectilinear bar 42 that is of rectangular transverse cross-sectional configuration and has affixed to the inboard end 44 of same a lock lifter portion 46 provided with the usual hook eye 48 that is adapted for conventional cooperation with the coupler lock lifter.

Figures 3, 4, 5, 6, 7, 8:
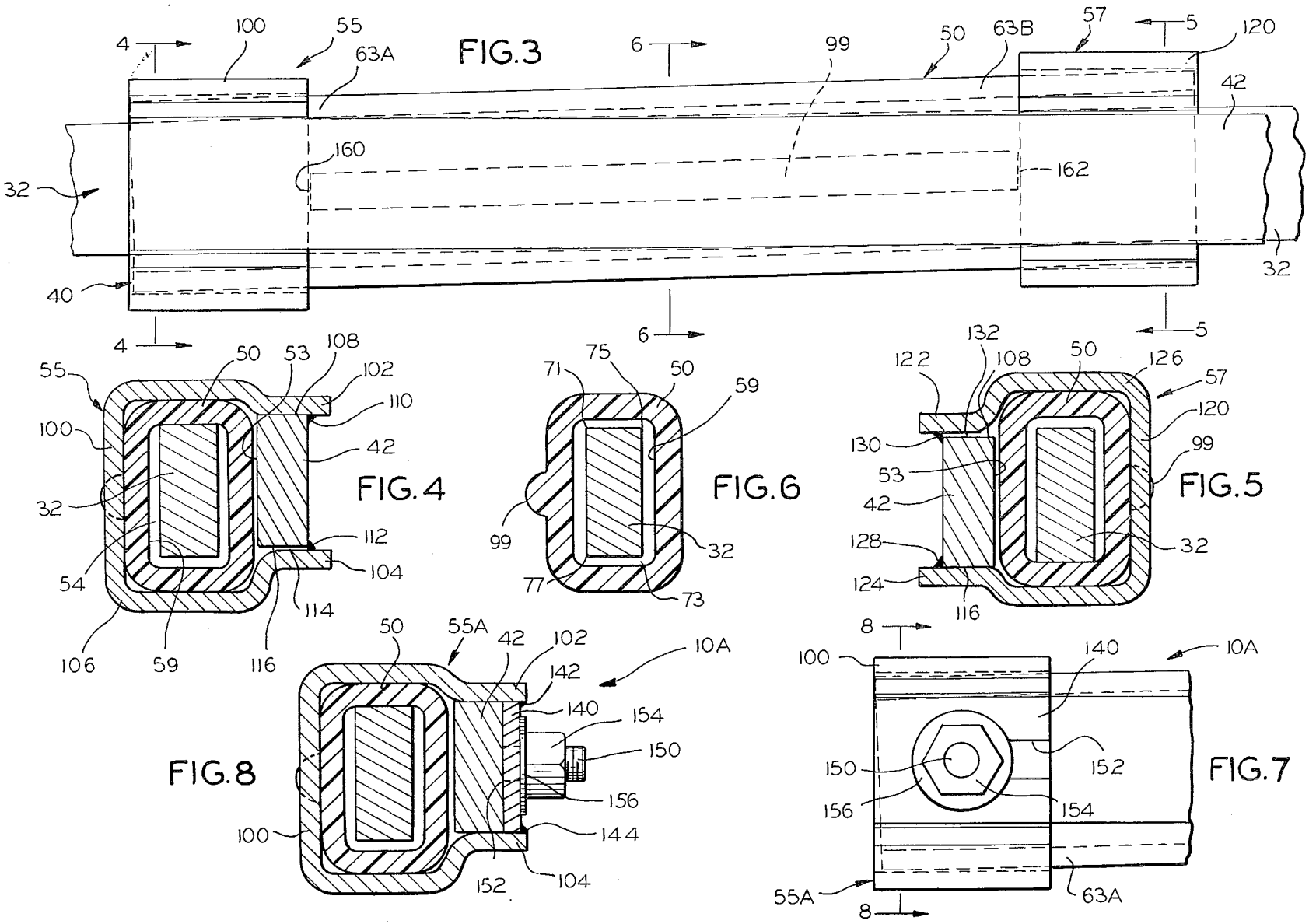
FIg. 3 is a fragmental view taken substantially along line 3—3 of FIG. 1, but on an enlarged scale, better illustrating the slideway forming tube of the uncoupling lever assembly and its manner of application in the uncoupling lever assembly.
FIG. 4 is a sectional view taken substantially along line 4—4 of FIG. 3.
FIG. 5 is a sectional view taken substantially along line 5—5 of FIG. 3.
FIG. 6 is a sectional view taken substantially along line 6—6 of FIG. 3.
FIG. 7 is a view similar to that of FIG. 3 illustrating the outboard end of the slideway forming tube and illustrating a modified form of the invention.
FIG. 8 is a sectional view similar to that of FIG. 4 but taken along line 8—8 of FIG. 7.

In accordance with the present invention, the outboard end 52 of the lock lifter section bar 42 has secured thereto tubular member or tube 50 that defines a slideway 54 (see FIGS. 4 – 6) in which the handle section bar 32 is freely received (see FIGS. 4, 5 and 6). The tube 50 is applied to the side 53 of the bar 42 that is to face the end of the railroad car body 14, and is secured to the bar 42 by brackets 55 and 57. The tube 50 is not bonded to either of the brackets 55 or 57 or to the bar 42, and is provided with a locating ridge or ledge 59 that extends between the respective brackets 55 and 57 (see FIG. 3) to maintain the tube 50 against movement longitudinally of the bar 42.

The tube 50 defines a bore 59 that has a transverse cross-sectional configuration generally resembling that of the bar 32, but proportioned so that when the bar 32 is centered relative to the tube bore 59, the spacing on the order of one-eighth of an inch separates the bar 32 from the tube servicing defining the bore 59 (this spacing being somewhat exaggerated in the drawings to provide clarity of illustration). This spacing provides a loose fit of the handle section bar within the lock lifter section slideway forming tube that accommodates propoer fitting of the hook eye 48 which avoids binding of the hook eye 48 with the lock lifter due to minor misalignment problems when the lock lifter is operated.

As indicated in FIGS. 3, 4 and 5, the tube 50 extends generally longitudinally of the lock lifter section bar 42, but it is canted somewhat with respect thereto so that its outboard end 63A is displaced downwardly somewhat of the bar 42 and its inboard end 63B is displaced upwardly somewhat of the bar 42. In accordance with this invention, the canting of the tube 50 relative to the bar 42 is such that when the assembly sections are in their positions of maximum extension, the bars 32 and 42 will be in substantial parallelism.

This relationship of parts eliminates a so-called "scissors effect" that tends to occur as the lock lifter section 40 moves to its position extension relative to the section 30, under the action of gravity, on the assembly components (when the assembly is mounted in its operating position), whereby the inboard end 38 of the handle section bar 32 tends to drop below the level of the lock lifter section bar 42.

The bar 42 of lock lifter section 40 is free and unencumbered along its side 53 for ready movement of the lock lifter section 40 relative to the handle section 30, to the extent that the end 38 of the handle section bar 32 may pass well beyond the juncture of the lock lifter portion 46 and bar 42 when the assembly 10 is fully contracted to the extent that the bracket 55 engages handle portion 34.

Figure 1:
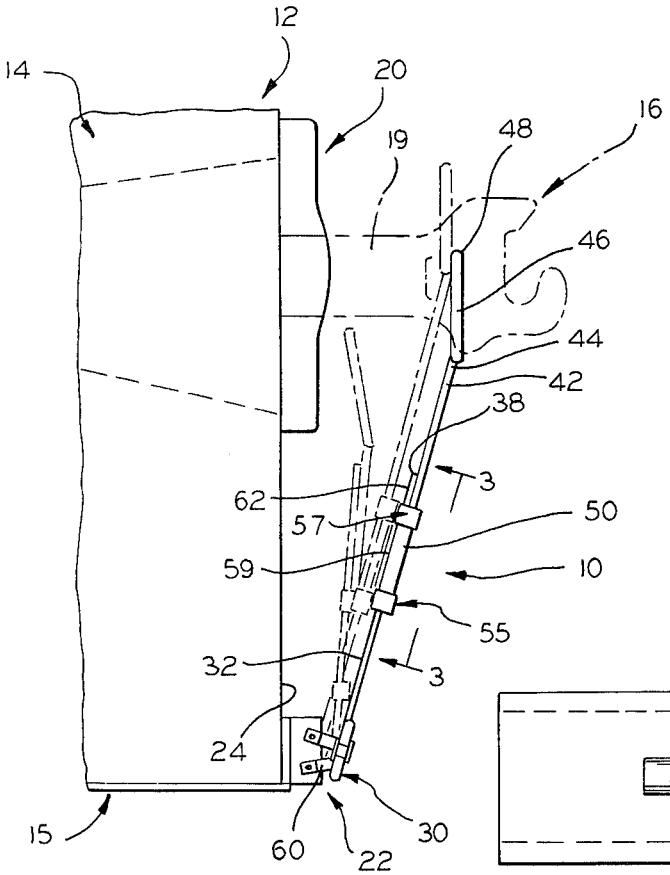

The section bars 32 and 42 are proportioned so that when the coupler 16 is centered with respect to the center line of the car 15, the end 38 of the handle section bar 32 projects inboard of the tube 50 approximately the amount indicated in FIGS. 1 and 2.

The assembly 10 may be applied to the car 15 without uncoupling the coupler 16 by taking the lock lifter section 40, by itself, and separated from the handle section 30, angling the bar section downwardly in the manner indicated in broken lines in FIG. 2, and applying the hook eye 48 to the coupler lock lifter, after which the lever assembly lock lifter section 40 may be swung vertically to receive the handle section 30 by applying its bar 32 to the guideway 54.

Following the disclosure of said U.S. Pat. No. 3,834,554, the lever handle portion 34 is applied to the car by being received in the oar lock type mounting device 61 that is fully described in said U.S. Pat. No. 3,834,554, that is applied to the clevis 60 which is in turn applied to the car body bracket 22. Both the car bracket 22 and clevis 60 may be arranged as described in said U.S. Pat. No. 3,834,554.

It will be apparent from FIGS. 1 and 2 that as the coupler 16 swings back and forth in service, the lock lifter section 40 of assembly 10 slides along the handle section bar 32, with the portion 62 of the handle section bar 32 that projects inboard of the slideway 54 providing for the extension and contraction of the effective length of the assembly 10, as required by coupler swing and draft gear travel under coupler impacts, following disclosure of said U.S. Pat. No. 3,834,554.

As disclosed in said U.S. Pat. No. 3,834,554, it is preferable that the parts be proportioned so that when the assembly 10 is operably mounted on the car, the handle section bar 32 extends within the slideway 54 approximately six inches when the assembly 10 is at its maximum extended relation, and when the assembly is in its minimum contracted relation as mounted for use, the bracket 55 is well short of handle portion 34.

Under the action of gravity, with the loose fit of the bar 32 within slideway 54 that is provided, the handle section bar 32 tends to engage the upper side of the slideway forming tube bore 59 at the end 63A of tube 50, and the bar 32 tends to engage the lower side of the tube bar 59 at the tube end 63B (see FIGS. 4 and 5, respectively). However, the canted mounting of the tube 50 relative to the lock lifter section bar 42 results in the bars 32 and 42 being in substantial alignment longitudinally of the assembly 10.

The loose fit type mounting of the handle section bar 32 is of such a character that if the coupler lock lifter and lever assembly hook eye are somewhat out of desirable working alignment, the lock lifter section is free to cant somewhat, sidewise of the assembly, in accommodating proper fitting of the hook eye with the coupler lock lifter. In other words, the fit of bar 32 within slideway 54 is sufficiently loose so that the tube 50 is free to shift relative to bar 32, under the action of the hook eye engaging and/or operating the lock lifter, that the tube 50 "seeks" a work relation position relative to bar 32 that may result in tube 50 being turned somewhat clockwise or counterclockwise of the relative positionings shown in FIGS. 4 – 6. Such "seeking" movement may bring the tube inner surfacing in engagement with opposed side edge corner portions of the bar 32, such as corner portions 71 and 73, or corner portions 75 and 77; however, the material from which tube 50 is formed readily accommodates any additional stress concentrations that may result, and that proportioning of parts involved also will result that such cocking of the tube 50 relative to bar 32 will lengthen the areas of contact of the tube with the bar 32 at either end of the tube due to the centering action of the tube on the bar 32 that tends to take place as the tube 50 shifts about the longitudinal axis of the bar 32.

SPECIFIC DESCRIPTION

Figure 9:
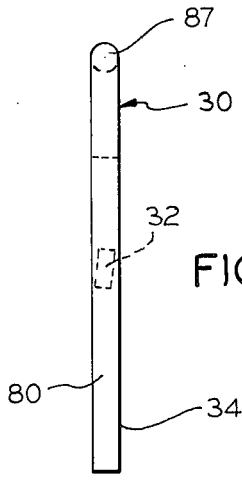
FIG. 9 is an end elevational view of the handle section of the uncoupling assembly illustrated, as viewed from the left hand end of same as shown in FIG. 2.
Figure 10:
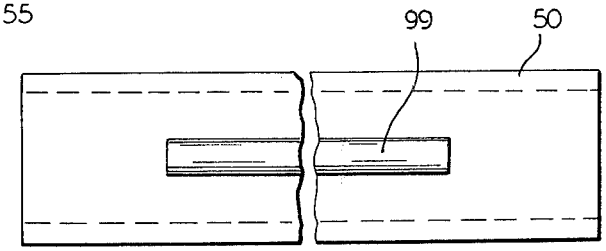
FIG. 10 is an elevational view of the slideway forming tube as seen from the back side of same as the tube is viewed in FIG. 3.

The handle section 30 of assembly 10 may be made in accordance with the disclosure of said U.S. Pat. No. 3,834,554, and thus the bar 32 is formed from a suitable bar stock (preferably made of a suitable grade of steel) of uniform transverse cross-sectional configuration throughout its length, its end 36 being suitably welded to handle portion 34, which in turn comprises a length 80 of suitable round stock having a rectilinear portion 82 which defines the operating handle 84 of the assembly. The rectilinear portion 82 merges into open looped end portion 86 that defines the open eye 87 that is applied to the mounting device 61. As indicated in FIG. 9, the handle 84 and looped end 86 are in coplanar relation, and they are in coplanar relation with the bar 32, with the operating handle also being angled relative to the longitudinal axis of bar 32 approximately 20 degrees.

The bar 42 of lock lifter section 40 is also formed from suitable bar stock (preferably a suitable grade of steel, as in the case of bar 32), and the lock lifter portion 46 comprises a length 90 of round stock shaped to define riser portion 92 having its end 94 suitably affixed to the end 44 of the bar 42, as by welding, and its other end 96 merging into rectilinear extension portion 98 that in turn merges into the hook eye 48, all as described in said U.S. Pat. No. 3,834,554.

The tube 50, in accordance with this invention, is a one piece component suitably formed from a suitable high density type polymer having self-lubricating characteristics, such as polyethylene. It has been found that for purposes of this invention the so-called ultra high molecular weight polymers are required; one suitable material of this type is polyethylene having a molecular weight of at least 2,000,000. Other comparable materials may also be employed. The molecular weight should be at least 2,000,000 and no greater than about 10,000,000, as material having a molecular weight much above 10,000,000 becomes too difficult to work. The high molecular weight range specified insures the high strength wear resisting self-lubricating low coefficient of dynamic friction characteristics desired for this invention while at the same time providing a material that resists flow under significant unit pressures and yet is sufficiently workable in nature to permit formation, by extrusion or injection molding, of the product shape desired.

The tube 50 in shape is essentially quadrilateral in transverse cross-sectional configuration, in general conformity to the transverse cross-sectional configuration of the bar 32 it receives, and is of uniform cross-sectional thickness from one end to the other except at the location of the ridge or ledge 99. Where the tube 50 is extruded, the ridge 99 may be formed the full length of the tube 50 and then excised as necessary to apply the brackets 55 and 57 to same.

Alternately, the tube 50 may be extruded in uniform transverse cross-sectional shape throughout its length, without ridge 59, and the ridge 59 would then comprise a separate member suitably affixed to the tube 50 in the position indicated. In any event, the tube 50 is arranged so that either end of same may serve as the outboard end 63A.

The brackets 55 and 57 are of identical construction. As indicated in FIG. 4, the bracket 55 comprises a clip element 100 of generally C-shaped transverse cross-sectional configuration comprising a pair of spaced apart, projecting end portions 102 and 104 that are in generally parallel relation and integral with a bight portion 106 that is proportioned to closely receive the tube 50. As indicated in FIG. 4, the clip ends 102 and 104 are spaced apart to exceed the depth dimension of the lock lifter bar 42 somewhat (a distance of about one-eighth of an inch is preferred), with the upper edge 108 of the bar 42 being placed in engagement with the clip end 102 and welded thereto as at 110. The bar 42 is also welded to the clip end 104 as at 112 with a spacing 114 resulting between the lower edge 116 of the bar 42 and the clip end 104.

The bracket 57 comprises a clip element 120 having parallel spaced apart, projecting ends 122 and 124 which merge into bight portion 126 that is proportioned to closely receive the end 63B of the tube 50. The ends 122 and 124 of the clip element 120 are spaced apart in the same manner as ends 102 and 104 of the clip element 106, with the lower edge 116 of the bar 42 being welded in engagement with the clip end 124, as at 128, and the clip end 122 being welded to the bar 42 as at 130, thereby leaving a space 132 between the clip end 122 and the bar upper edge 108.

The clip members 100 and 120 are of identical shape and construction, and, as indicated, they are shaped so that their respective bight portions 106 and 126 closely receive and engage the respective ends of the tube to hold affixed against movement relative to the bar 42. Bracket 57 is first applied to the bar 42, after which the tube end 63B is inserted within the bracket 57, the bracket 55 applied to the tube end 63A and welded in place in the manner indicated in FIG. 4. This results in the canted positioning of the tube 50 relative to the bar 42 that overcomes the tendency of bars 32 and 42 to "scissors" out of alignment as the assembly approaches full extension.

In the alternate form shown in FIGS. 7 and 8, the assembly 10A is the same as assembly 10 except that the bracket 55A, which is located at the outboard end of the lock lifter section bar 42, is removably mounted in place so that the tube 50 may be replaced if and when desired.

For this purpose, the bracket 55A comprises clip member 100 that is the same as the member 100 of FIG. 4, but has a mounting plate 140 fixed between its end portions 102 and 104, as by welding at 142 and 144, respectively.

The bar 42 has fixed to same, as by welding, a Nelson stud 150, which is received in slot 152 formed in mounting plate 140 when clip 100 of FIGS. 7 and 8 is slipped over the end 63A of tube 50 and end 52 of bar 42, and against tube ridge 59, after which nut 154 applied to stud 150 against lock washer 156 removably secures bracket 55A in mounted position by loosening nut 150, bracket 55A may be moved endwise of the bar 42 to free the end 63A of the tube from the bar 42 for removal and replacement when desired.

It will thus be seen that the tube 50 is free of bonded engagement with either the lock lifter section bar 42 or the brackets that secure same to the bar 42, while, nevertheless, being firmly secured in place. The brackets 55 and 57 (or 55A and 57) are applied to the tube 50 to bring the ends 160 and 162 of the tube ridge 59 in substantial abutting relation thereto whereby the tube 50 is held against movement longitudinally of the bar 42 by the indexing action of the tube ridge 59.

The ultra high molecular weight, and thus high density polymeric material from which the tube 50 is formed, insures among other things a low coefficient of dynamic friction between the handle section bar 32 and the tube 50. While a wide variety of materials may be selected to form the tube 50, the high density material employed, in addition to being self-lubricating and having a molecular weight on the order of that indicated, preferably should be of the type that provides a coefficient of dynamic friction on the order of .02 between the surfacing of the bar 32 and the tube 50, and polyethylene of the ultra high molecular weight type specified has a coefficient of friction relative to mild steel in the range of 0.12–0.20.

This together with the resistance to flow that the material making up tube 50 has, insures that even though the tube 50 may be cocked somewhat relative to the bar 32, either longitudinally of the bar 32 or sidewise of same or both, the movement of the tube 50 longitudinally of the bar 32 due to coupler side swing remains smooth and unimpeded.

Tests have shown that assemblies 10 having a tube 50 of the type herein described may undergo up to 1,000,000 cycles or more (repeated extension and retraction of the assembly 10) without any significant galling or jamming of the parts involved occurring.

It is thus apparent that the invention not only provides a slideway forming arrangement for the take up and let out portion of the uncoupling lever that overcomes prior failure problems, but that the arrangement also accommodates minor misalignments of the lock lifter and uncoupling lever hook eye, as well as the tendency of the section bars of the particular uncoupling lever assembly illustrated from being subjected to the undesirable "scissors effect" due to gravity and the manner of their interconnection and cantilevered support at their respective opposite ends that is employed.

Another advantage of the invention is that the materials from which the tube is to be formed make the tube inert and impervious to petroleum products, and foreign materials that become interposed within the slideway tend to become embedded in the material forming the tube which thus avoids adverse effect of such foreign materials on the operation of the uncoupling lever. The self-lubricating characteristics of the material avoid the need to lubricate the uncoupling lever slideway 54 which avoids the safety problem that has been mentioned.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

We claim:

1. In an uncoupling lever device for a railroad car having a coupler mounted at one end thereof for side to side swinging movement and movement longitudinally of the car in response to buff and draft forces and including a lock lifter for uncoupling the coupler, with said uncoupling device including a lever assembly comprising a lock lifter section including a hook eye at one end thereof adapted to operatively engage the lock lifter for support by the coupler, and a handle section including a handle portion at one end thereof adapted to be pivotally secured to the car to one side of the end of the car to swing about a pivot point to move said hook eye portion to operate said lock lifter, for mounting the lever assembly in operative relation on the car, with the handle section comprising an elongate rectilinear bar of polygonal transverse cross-sectional configuration, with the handle portion being fixed to one end of said bar, and the lock lifter section comprising an elongate rectilinear bar having the hook eye affixed to one end of same, and with the lock lifter section bar adjacent the other end of same including an elongate slideway extending generally longitudinally same, and the handle section bar slidably received in said slideway in cranking relation to the lock lifter section bar for accommodating shifting action of the lock lifter section relative to the handle section on side to side swinging movement of the coupler, the improvement wherein:

said slideway comprises:

an elongate tube having a bore defining slideway surfacing thereabout formed from a high density polymer having self-lubricating characteristics, said tube being open at either end of same for free travel of said lock lifter section slideway longitudinally of said handle section bar to, on movement of said lock lifter section bar toward the handle portion, dispose the other end of said handle section bar exteriorly of said slideway at the hook eye end of same for accommodating contraction of said device under coupler swing when the coupler swings toward said handle portion, said bars being formed for free travel of said lock lifter section bar relative to said handle section bar, on said movement to project said other end of said handle section bar from said slideway, to adjacent said one end of said lock lifter section bar, and for free travel of said slideway lengthwise of said handle section bar, said bars being proportioned to dispose said other end of said handle section bar intermediate said one end of said lock lifter section bar and the slideway inboard end when the coupler is centered relative to the car, and means for fixing said tube to said lock lifter section bar against movement longitudinally of said lock lifter section bar, with said tube being free of bonded connection to said lock lifter section bar.

2. The improvement set forth in claim 1 wherein:

said tube bore is proportioned relative to said handle section bar to accommodate limited tilting of said tube relative to said handle section bar, sidewise of said bars, for accommodating fitting of the lock lifter section hook eye on the coupler lock lifter.

3. The improvement set forth in claim 1 wherein:

said tube is in tilted relation, longitudinally of said lock lifter section bar, for disposing said bars in substantially parallel relation, when the lever assembly is in extended relation, against the action of gravity on said bars when the lever assembly is in operative relation on the car.

4. The improvement set forth in claim 1 wherein said fixing means comprises:

a bracket adjacent either end of said tube, means for making said brackets fast to said lock lifter section bar, said brackets being formed to slidably receive the respective ends of said tube, said tube being formed with a centering ridge extending longitudinally thereof and between said brackets for maintaining said tube against shifting movement, longitudinally thereof, relative to said brackets.

5. The improvement set forth in claim 1 wherein:

said tube is of one piece construction formed from said polymer.

6. The improvement set forth in claim 4 wherein:

said brackets each comprise a clip of substantially C-shaped configuration, said means for making said brackets fast to said lock lifter section bar comprising:

said clips having their respective ends secured to said lock lifter section bar wtih the bight portions of said clips receiving the respective ends of said tube.

7. The improvement set forth in claim 6 wherein:

said clips ends are permanently fixed to said lock lifter section bar.

8. The improvement set forth in claim 6 wherein:

one of said clips is removably secured to said lock lifter section bar for removably mounting said tube on said lock lifter section bar.

9. The improvement set forth in claim 6 wherein:

said clips are secured to said lock lifter section bar in offset relation relative to the longitudinal axis of said bar to angularly mount said tube on said lock lifter bar for disposing said bars in substantially parallel relation, when the lever assembly is inextended relation, against the action of gravity on said bars when the lever assembly is in operative relation on the car.

10. The improvement set forth in claim 4 wherein:

said handle section bar is on the side of said lock lifter section bar that is to face the car, said tube being on the side of said lock lifter section bar that is to face the car, said tube centering ridge projecting away from said side of said lock lifter section bar.

11. In a railroad car adapted to ride on track rails and having a coupler mounted at one end thereof for side to side swinging movement and movement longitudinally of the car in response to buff and draft forces and including a lock lifter for uncoupling the coupler, and an uncoupling device including a lever assembly comprising a lock lifter section including a hook eye at one end thereof operatively engaging the lock lifter and supported by the coupler for pivotal movement about a pivot pin point lift the lock lifter to uncouple the coupler, and a handle section including a handle portion at one end thereof pivotally secured to the car to one side of the end of the car to swing about a pivot point to move said hook eye portion to operate said lock lifter for mounting the lever assembly in operative relation on the car, with the handle section comprising an elongate rectilinear bar of polygonal transverse cross-sectional configuration, with the handle portion being fixed to one end of said bar, and the lock lifter section comprising an elongate rectilinear bar having the hook eye affixed to one end of same, and with the lock lifter section bar adjacent the other end of same including an elongate slideway extending generally longitudinally of same, and the handle section bar slidably received in said slideway in cranking relation to the lock lifter section bar for accommodating shifting action of the lock lifter section relative to the handle section on side to side swinging movment of the coupler, the improvement wherein:

said slideway comprises:

an elongate tube having a bore defining slideway surfacing thereabout formed from a high density polymer having self-lubricating characteristics, said tube being open at either end of said for free travel of said lock lifter section slideway longitudinally of said handle section bar to, on movement of said lock lifter section bar toward the handle portion, dispose the other end of said handle section bar exteriorly of said slideway at the hook eye end of same for accommodating contraction of said device under coupler swing when the coupler swings toward said handle portion, said bars being formed for free travel of said lock lifter section bar relative to said handle section bar, on said movement to project said other end of said handle section bar from said slideway, to adjacent said one end of said lock lifter section bar, and for free travel of said slideway lengthwise of said handle section bar, said bars being proportioned to dispose said other end of said handle section bar intermediate said one end of said lock lifter section bar and the slideway inboard end when the coupler is centered relative to the car, and means for fixing said tube to said lock lifter section bar against movement longitudinally of said lock lifter section bar, with said tube being free of bonded connection to said lock lifter section bar.

12. The improvement set forth in claim 11 wherein:

said tube bore is proportioned relative to said handle section bar to accommodate limited tilting of said tube relative to said handle section bar, sidewise of said bars, for accommodating fitting of the lock lifter section hook eye on the coupler lock lifter.

13. The improvement set forth in claim 11 wherein:

said tube is in tilted relation, longitudinally of said lock lifter section bar, for disposing said bars in substantially parallel relation, when the lever assembly is in extended relation, against the action of gravity on said bars when the lever assembly is in operative relation on the car.

14. The improvement set forth in claim 11 wherein said fixing means comprises:

a bracket adjacent either end of said tube, means for making said brackets fast to said lock lifter section bar, said brackets being formed to slidably receive the respective ends of said tube, said tube being formed with a centering ridge extending longitudinally thereof and between said brackets for maintaining said tube against shifting movement, longitudinally thereof, relative to said brackets.

15. The improvement set forth in claim 1 wherein:

said polymer is of the ultra high molecular weight type having a molecular weight of at least 2,000,000.

16. The improvement set forth in claim 1 wherein:

said handle section bar is formed from steel, said slideway surfacing having a dynamic coefficient of friction on said handle section bar on the order of 0.02.

* * * * *